US006353984B1

(12) United States Patent
Wilson

(10) Patent No.: US 6,353,984 B1
(45) Date of Patent: Mar. 12, 2002

(54) DEVICE FOR HOLDING A PATCH

(76) Inventor: Theodore J. Wilson, PMB 244, 1701 Broadway, Vancouver, WA (US) 96883

( * ) Notice: Subject to any disclaimer, the term of this patent is extended or adjusted under 35 U.S.C. 154(b) by 18 days.

(21) Appl. No.: 09/591,063

(22) Filed: Jun. 9, 2000

(51) Int. Cl.[7] ..... A44B 1/32; A45F 5/08

(52) U.S. Cl. ..... 24/706.4; 24/706.5; 24/114.5; 24/114.4; 24/104

(58) Field of Search ..... 24/706.4, 706.5, 24/114.5, 104

(56) References Cited

U.S. PATENT DOCUMENTS

| | | | | | |
|---|---|---|---|---|---|
| 2,524,842 | A | * | 10/1950 | Slamon et al. | 24/114.5 |
| 2,730,824 | A | | 1/1956 | Cohen | |
| 3,360,835 | A | * | 1/1968 | Foertmeyer | 24/114.4 |
| 3,546,797 | A | | 12/1970 | Oleson | |
| 3,735,447 | A | * | 5/1973 | Abraham | 24/706.4 |
| D268,120 | S | | 3/1983 | Kleiner | |
| 4,813,110 | A | * | 3/1989 | Schiller | 24/104 |
| 4,961,275 | A | | 10/1990 | Klein | |
| 5,504,976 | A | | 4/1996 | Reeves | |
| 5,584,104 | A | * | 12/1996 | Stuart | 24/104 |
| 5,603,143 | A | * | 2/1997 | Rucker | 24/104 |
| 5,655,271 | A | | 8/1997 | Maxwell-Trumble et al. | |

* cited by examiner

*Primary Examiner*—Victor N. Sakran

(57) ABSTRACT

A device for holding a patch for holding a patch stationary with respect to a fabric so that the patch may be easily sewn to the fabric. The device for holding a patch includes a female plate having central wall with a top surface and a bottom surface. A male plate having a central wall with a top surface and a bottom surface. At least one bore in the female plate. An upstanding member, for insertion into the bore is fixedly coupled to the bottom surface of the male plate. The upstanding member has a pointed free end. A retainer retains the upstanding member in the female plate.

7 Claims, 2 Drawing Sheets

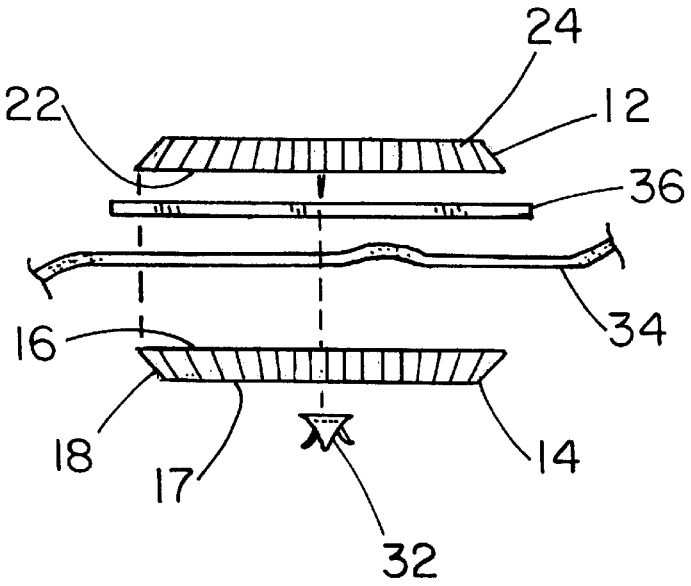
FIG. 3
FIG. 4
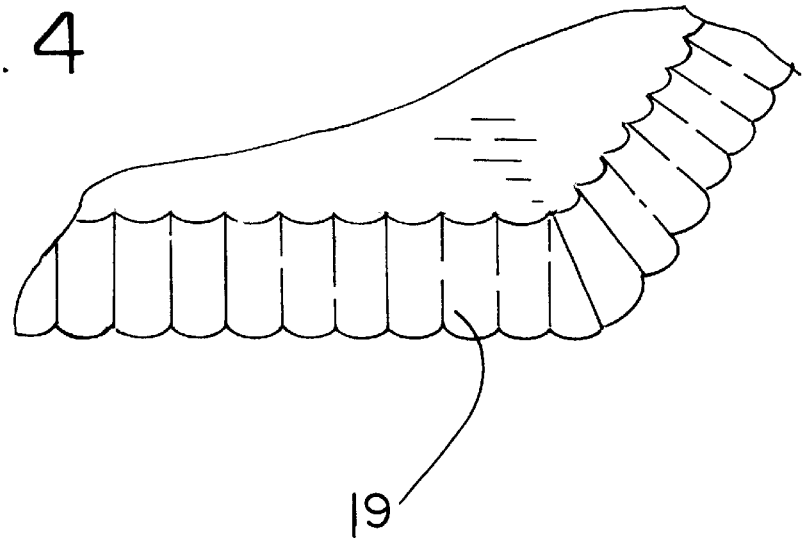

DEVICE FOR HOLDING A PATCH

BACKGROUND OF THE INVENTION

1. Field of the Invention

The present invention relates to sewing devices and more particularly pertains to a new device for holding a patch for holding a patch stationary with respect to a fabric so that the patch may be easily sewn to the fabric.

2. Description of the Prior Art

The use of sewing devices is known in the prior art. More specifically, sewing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,655,271; U.S. Pat. No. 4,961,275; U.S. Pat. No. 3,546,797; U.S. Pat. No. 2,730,824; U.S. Pat. No. 5,504,976; and U.S. Des. Pat. No. 268,120.

While these devices fulfill their respective, particular objectives and requirements, the aforementioned patents do not disclose a new device for holding a patch. The inventive device includes a female plate having central wall with a top surface and a bottom surface. A male plate having a central wall with a top surface and a bottom surface. At least one bore in the female plate. An upstanding member, for insertion into the bore is fixedly coupled to the bottom surface of the male plate. The upstanding member has a pointed free end. A retainer retains the upstanding member in the female plate.

In these respects, the device for holding a patch according to the present invention substantially departs from the conventional concepts and designs of the prior art, and in so doing provides an apparatus primarily developed for the purpose of holding a patch stationary with respect to a fabric so that the patch may be easily sewn to the fabric.

SUMMARY OF THE INVENTION

In view of the foregoing disadvantages inherent in the known types of sewing devices now present in the prior art, the present invention provides a new device for holding a patch construction wherein the same can be utilized for holding a patch stationary with respect to a fabric so that the patch may be easily sewn to the fabric.

The general purpose of the present invention, which will be described subsequently in greater detail, is to provide a new device for holding a patch apparatus and method which has many of the advantages of the sewing devices mentioned heretofore and many novel features that result in a new device for holding a patch which is not anticipated, rendered obvious, suggested, or even implied by any of the prior art sewing devices, either alone or in any combination thereof.

To attain this, the present invention generally comprises a female plate having central wall with a top surface and a bottom surface. A male plate having a central wall with a top surface and a bottom surface. At least one bore in the female plate. An upstanding member, for insertion into the bore is fixedly coupled to the bottom surface of the male plate. The upstanding member has a pointed free end. A retainer retains the upstanding member in the female plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new device for holding a patch apparatus and method which has many of the advantages of the sewing devices mentioned heretofore and many novel features that result in a new device for holding a patch which is not anticipated, rendered obvious, suggested, or even implied by any of the prior art sewing devices, either alone or in any combination thereof.

It is another object of the present invention to provide a new device for holding a patch which may be easily and efficiently manufactured and marketed.

It is a further object of the present invention to provide a new device for holding a patch which is of a durable and reliable construction.

An even further object of the present invention is to provide a new device for holding a patch which is susceptible of a low cost of manufacture with regard to both materials and labor, and which accordingly is then susceptible of low prices of sale to the consuming public, thereby making such device for holding a patch economically available to the buying public.

Still yet another object of the present invention is to provide a new device for holding a patch which provides in the apparatuses and methods of the prior art some of the advantages thereof, while simultaneously overcoming some of the disadvantages normally associated therewith.

Still another object of the present invention is to provide a new device for holding a patch for holding a patch stationary with respect to a fabric so that the patch may be easily sewn to the fabric.

Yet another object of the present invention is to provide a female plate having central wall with a top surface and a bottom surface. A male plate having a central wall with a top surface and a bottom surface. At least one bore in the female plate. An upstanding member, for insertion into the bore is fixedly coupled to the bottom surface of the male plate. The upstanding member has a pointed free end. A retainer retains the upstanding member in the female plate.

Even still another object of the present invention is to provide a new device for holding a patch that can be made in various sizes for use for all types of patches.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic side view of the present invention.

FIG. 4 is a schematic perspective view of the peripheral wall of the present invention.

DESCRIPTION OF THE PREFERRED EMBODIMENT

Figure 1:
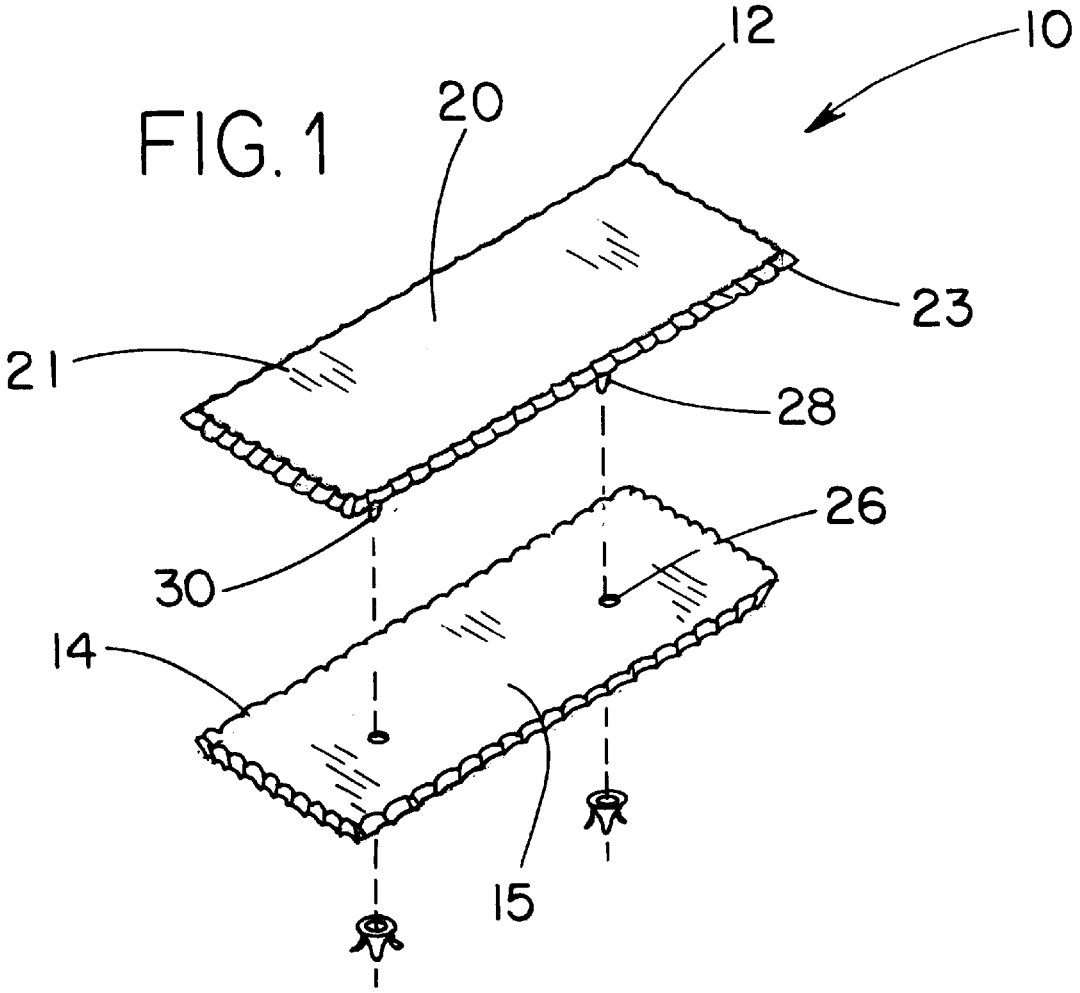
FIG. 1 is a schematic perspective view of a new device for holding a patch according to the present invention.
Figure 2:
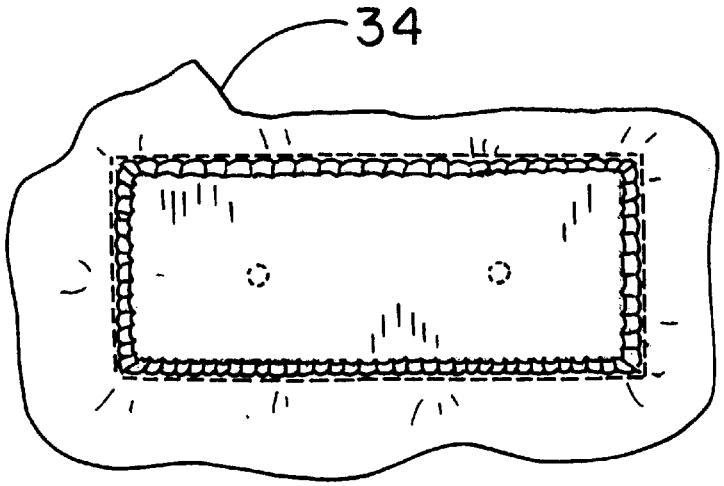
FIG. 2 is a schematic top view of the present invention.

With reference now to the drawings, and in particular to FIGS. 1 through 4 thereof, a new device for holding a patch embodying the principles and concepts of the present invention and generally designated by the reference numeral 10 will be described.

As best illustrated in FIGS. 1 through 4, the device for holding a patch 10 generally comprises a male 12 and a female 14 plate. The female plate 14 has central wall 15 with a top surface 17, and a bottom surface 16. The central wall 15, has a peripheral edge 18. The peripheral edge 18 extends outwardly away from the central wall 15 and slopes away the bottom surface 16. The peripheral edge 18 has a scalloped surface 19. The scalloped surface 19 is rounded. The scalloped surface has fold lines oriented generally perpendicular to a plane of the bottom surface 16. The top 15 and bottom 16 surfaces of the female plate 14 have a generally rectangular shape, although the shape may be dependent on the shape of the patch to be sewn to the fabric and any shape could be conceivable.

The male plate 12 has central wall 20 with a top surface 21 and a bottom surface 22. The central wall 20 has a peripheral edge 23. The peripheral edge 23 slopes away the bottom surface 22. The peripheral edge 23 has a scalloped surface 24. The scalloped surface 24 is rounded. The scalloped surface 24 has fold lines oriented generally perpendicular to a plane of the bottom surface 22. The male plate 12 ideally has dimensions substantially identical to the female plate 14 such that when a bottom surface 16 of the female plate is opposed to the bottom surface 22 of the male plate, the peripheral edges of the plates may be aligned.

A pair of bores 26 in the female plate 14 extends through the top 17 and bottom surfaces 16 of the female plate. The bores 26 are generally located along a longitudinal axis of the female plate 14. The number of bores can vary depending on the shape of the plates. A small plate may have only one bore however a large one may have a plurality of bores.

A pair of upstanding members 28 for insertion into the bores 26 is fixedly coupled to the bottom surface of the male plate 12. Each of the upstanding members 28 has a pointed free end 30. Each of the upstanding members 28 is generally located along a longitudinal axis of the male plate 12 such that each of the upstanding members 28 are insertable in one of the bores 26 when the female plate 14 is positioned adjacent to the male plate 12. The number of upstanding members 28 should be equal to the number of bores 26.

A pair of retainers 32, or fasteners, retains the upstanding members 28 in the female plate 14. Each of the retainers 32 is adapted for releasably capping one of the pointed ends 30 of the upstanding members 28. Each of the retainers 32 comprises a pressure clamp. Ideally, as with the upstanding members, the number of fasteners would equal the number of bores.

Preferably the male 12 and female 14 plates are comprised of a plastic material, however metal could also be used.

In use, the fabric 34 is placed on the female plate 14 and the patch 36 is placed over the fabric 34. The male plate 14 is pressed down onto the patch 36 such that the upstanding members 28 extend through the bores 26. The fasteners 32 are placed on the ends 30 of the upstanding members 28 to hold the plates 12, 14 against each other. The plates used are chosen with dimensions smaller than that of the patch 36 such that an edge of the patch 36 extends past the peripheral edges of the plates. The exposed edge of the patch 36 is sewn to the fabric 34. The scalloped edges facilitate easy sewing of the path to the fabric.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for holding a patch against a piece of fabric, said device comprising:

a female plate, said female plate having central wall with a top surface and a bottom surface, said central wall of said female plate having a peripheral edge having a scalloped surface, said scalloped surface being rounded, said scalloped surfaces having fold lines oriented generally perpendicular to a plane of said bottom surface of said female plate;

a male plate, said male plate having central wall with a top surface and a bottom surface;

at least one bore in said female plate;

at least one upstanding member for insertion into said bore, said upstanding member being fixedly coupled to said bottom surface of said male plate, said upstanding member having a pointed free end; and a retainer for retaining said upstanding member in said female plate.

2. The device for holding a patch against a piece of fabric as in claim 1, wherein said central wall of said male plate has a peripheral edge, said peripheral edge having a scalloped surface, said scalloped surface being rounded, said scalloped surface having fold lines oriented generally perpendicular to a plane of said bottom surface, wherein said male plate has a shape and size substantially identical to said female plate.

3. The device for holding a patch against a piece of fabric as in claim 2, further comprising:

wherein said bore is a plurality of bores, each of said bores extending through said top and bottom surfaces of said female plate, said bores being generally located along a longitudinal axis of said female plate;

wherein said upstanding member is a plurality of upstanding members such that for each bore the is a corresponding upstanding member, each of said upstanding members being positioned such that each of said upstanding members is removably insertable into one of said bores; and wherein said retainer includes a pair of retainers.

4. The device for holding a patch against a piece of fabric as in claim 1, wherein said bore is a pair of bores, each of said bores extending through said top and bottom surfaces of said female plate, said bores being generally located along a longitudinal axis of said female plate.

5. The device for holding a patch against a piece of fabric as in claim 4, wherein said upstanding member is a pair of upstanding members, each of said upstanding members being fixedly coupled to said bottom surface of said male plate, each of said upstanding members having a pointed free end, each of said upstanding members being generally located along a longitudinal axis of said male plate such that each of said upstanding members are insertable in one of said bores when said female plate is positioned adjacent to said male plate, wherein said retainer includes a pair of retainers.

6. The device for holding a patch against a piece of fabric as in claim 1, further comprising:

wherein said bore is a plurality of bores, each of said bores extending through said top and bottom surfaces of said female plate, said bores being generally located along a longitudinal axis of said female plate;

wherein said upstanding member is a plurality of upstanding members such that for each bore the is a corresponding upstanding member, each of said upstanding members being positioned such that each of said upstanding members is removably insertable into one of said bores; and wherein said retainer includes a pair of retainers.

7. A device for holding a patch against a piece of fabric, said device comprising:

a female plate, said female plate having central wall with a top surface, and a bottom surface, said central wall having a peripheral edge, said peripheral edge sloping away said bottom surface, said peripheral edge having a scalloped surface, said scalloped surface being rounded, said scalloped surface having fold lines oriented generally perpendicular to a plane of said bottom surface, said top and bottom surfaces of said female plate having a generally rectangular shape;

a male plate, said male plate having central wall with a top surface, and a bottom surface, said central wall having a peripheral edge, said peripheral edge sloping away said bottom surface, said peripheral edge having a scalloped surface, said scalloped surface being rounded, said scalloped surface having fold lines oriented generally perpendicular to a plane of said bottom surface, said male plate having dimensions generally identical to said female plate;

a pair of bores in said female plate, each of said bores extending through said top and bottom surfaces of said female plate, said bores being generally located along a longitudinal axis of said female plate;

a pair of upstanding members for insertion into said bores, each of said upstanding members being fixedly coupled to said bottom surface of said male plate, each of said upstanding members having a pointed free end, each of said upstanding members being generally located along a longitudinal axis of said male plate such that each of said upstanding members are insertable in one of said bores when said female plate is positioned adjacent to said male plate;

a pair of retainers for retaining said upstanding members in said female plate, each of said retainers being adapted for releasably capping one of said pointed ends of said upstanding members, each of said retainers comprising a pressure clamp; and wherein said male and female plates comprise a plastic material.

* * * * *